United States Patent [19]

Hall

[11] Patent Number: 4,461,651

[45] Date of Patent: Jul. 24, 1984

[54] SONIC CLEANING DEVICE AND METHOD

[75] Inventor: Richard I. Hall, St. Catherines, Canada

[73] Assignee: Foster Wheeler Limited, St. Catherines, Canada

[21] Appl. No.: 464,842

[22] Filed: Feb. 8, 1983

[51] Int. Cl.[3] ..... B08B 7/00

[52] U.S. Cl. ..... 134/1; 15/316 R; 15/404; 15/405; 15/406; 116/137 R; 134/37; 134/39; 165/95

[58] Field of Search ..... 134/1, 37, 39; 15/316 R, 404, 405, 406; 116/137 R; 165/95

[56] References Cited

U.S. PATENT DOCUMENTS

| | | | |
|---|---|---|---|
| 2,158,537 | 5/1939 | Garratt | 116/137 R |
| 2,351,163 | 6/1944 | Thomas | 134/1 X |
| 2,678,625 | 5/1954 | Hall et al. | 116/137 R |
| 3,071,145 | 1/1963 | Blanchard | 134/1 X |
| 3,568,238 | 3/1971 | Fischer | 15/316 R X |
| 3,943,884 | 3/1976 | Majkrzak | 116/137 R |
| 4,333,742 | 6/1982 | Tanca | 15/316 R X |
| 4,359,962 | 11/1982 | Olsson et al. | 116/137 R |

FOREIGN PATENT DOCUMENTS

| | | | |
|---|---|---|---|
| WO79/01019 | 11/1979 | PCT Int'l Appl. | 134/1 |

*Primary Examiner*—Marc L. Caroff

*Attorney, Agent, or Firm*—Marvin A. Naigur; John E. Wilson; Martin Smolowitz

[57] ABSTRACT

A sonic cleaning device and method for removing accumulated fine particles from surfaces such as in heat exchangers using sonic energy vibrations. In the invention, a gas is passed through a tube having internally corrugated walls and having the tube outlet end attached to the inlet end of an expanding horn. The gas flows past the corrugations at high velocity and produces high intensity sonic vibrations within the tube, and the vibrations are amplified by passage through the horn. The horn outlet is directed at a surface to be cleaned and the accumulated particles are fluidized by the sonic energy and removed from the surface by the flowing gas and/or by gravity.

18 Claims, 4 Drawing Figures

SONIC CLEANING DEVICE AND METHOD

BACKGROUND OF INVENTION

This invention pertains to a sonic cleaning device and method for cleaning surfaces to remove accumulated particles therefrom by using sonic energy. It pertains more particularly to a conduit device having internally corrugated tube walls and through which a process gas is passed at velocities sufficient to generate sonic energy in the form of high intensity vibrations within the gas stream to fluidize accumulated particles and produce a cleaning effect.

The use of sonic energy for cleaning applications is generally known, such as for use in liquid baths or medium and also for removing solids. For example, U.S. Pat. No. 3,467,363 to Reichel discloses use of a sound wave generator for moving and dislodging fine particle materials such as grains stored in storage silos. U.S. Pat. No. 3,631,792 to Bodine discloses using sonic energy in an engine combustion gas exhaust system for performing a cleaning action for removing soot from catalyst particles. Also, U.S. Pat. No. 3,943,884 to Majkrzak discloses passing a gas through a corrugated tubing to produce sonic energy at various frequencies depending on the gas inlet pressure and mass flow rate through the tube, however, no cleaning utility is suggested. Thus, the prior art has evidently not disclosed any apparatus and method for using sonic energy or intense high frequency sound waves generated in a gas in a tube for particle fluidization and removal to clean surfaces.

SUMMARY OF THE INVENTION

This invention provides a sonic cleaning device and method for removing fine accumulated particles from a surface using sonic energy, and particularly provides a cleaning device using high intensity sound waves generated in an internally corrugated tube sound source by a gas passing therethrough. The vibrations so produced are amplified by a horn connected to the tube for fluidizing and removing accumulated particles from surfaces, such as heat transfer surfaces, using a flowing gas or process fluid. The invention comprises an internally corrugated tube in which sound vibrations are produced, by a gas flowing through the tube, which is connected at one end to an expanding horn for directing and intensifying the sound energy. The horn is directed toward a surface to be cleaned of accumulated particles, and a gas is passed through the conduit device at a superficial gas velocity sufficient to produce high intensity sound waves in the tube, so as to fluidize the particles and thereby remove the accumulated particles from the surface.

The tube internal corrugations and tube length are each sized so as to produce sound of the appropriate frequency and intensity ranges, so as to fluidize any particles accumulated on surfaces toward which the horn is directed. The sonic cleaning device and method can be used with any flowing gas for producing the sound vibrations, such as a process gas, air, or steam.

It is an advantage of the present invention that the sonic cleaning device has no moving parts and is useful over a wide range of internal gas pressures for removing adhering particles from a surface to be cleaned, such as from a heat transfer surface for process fluids. It is a further advantage that the cleaning device can be operated using any gas, such as that being heated or cooled in the heat exchange surfaces being cleaned, for example, removing accumulated soot from steam boiler tubes or removing accumulated particles from metallurgical waste heat boiler surfaces.

DESCRIPTION OF INVENTION

Figure 1:
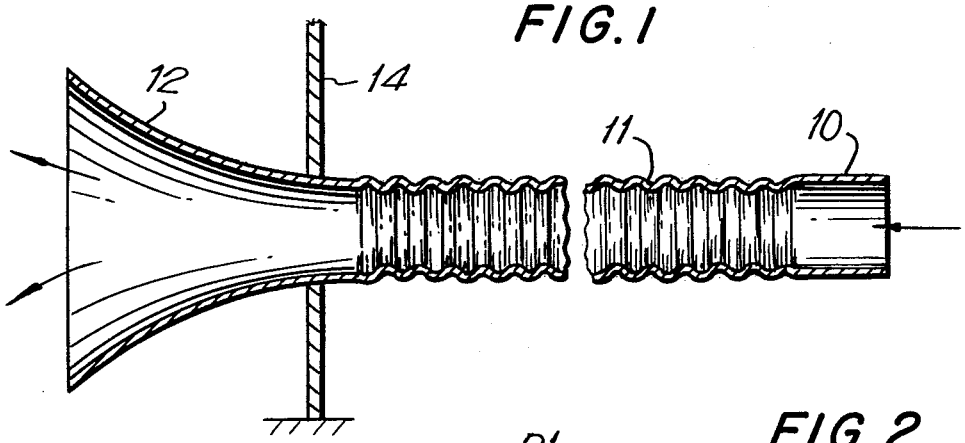
FIG. 1 is a cross-sectional view of a sonic device comprising an internally corrugated tube and expanding horn combination according to the invention.

The present invention will now be described in greater detail with reference to the above drawings. As shown in FIG. 1, a pressurized gas such as air is passed through an inlet end 10 into an internally corrugated tube 11, in which high intensity sound vibrations or sonic waves are formed or produced as a result of the gas passing over the corrugated surfaces at a flow velocity within a specific range. The corrugated tube 11 is connected at its outlet end to an expanding horn 12, and the tube-horn conduit device can be conveniently supported by a plate 14 attached to the outer surface of horn 12. The frequency and intensity of the sound vibrations generated in tube 11 depends on the gas flow velocity through the tube, which should be at least about 25 ft./sec. superficial gas velocity and usually need not exceed about 200 ft./sec. for achieving good results. We should attain a sound frequency which is as low as is possible, while achieving a sound intensity from the horn that should be at least about 100 decibels and preferably approximately 120 to 160 decibels.

The tube internal corrugations can be made either parallel or helical shaped, but are preferably made parallel to each other and at an angle of about 75–90 degrees with the tube centerline. The corrugated tube inner diameter should be about 0.8–2.0 inch, the corrugation pitch should be about 0.2–0.5 inch, and the ratio of tube length to inside diameter should be at least about 10, and need not exceed about 100. The tube wall thickness will be determined by the internal pressure of the gas flowing in the tube and the tube material of construction. Because the sound vibrations produced are a surface phenomenon between the flowing gas and the corrugated surface boundary layer, the tube wall does not vibrate and the fluid vibrations within the tube are substantially independent of the wall thickness. An internally corrugated tube 20 having increased wall thickness 21 and with a smooth outer wall surface is shown by FIG. 2.

Figure 3:
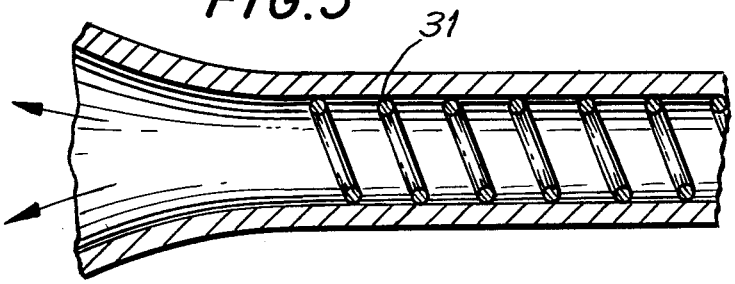
FIG. 3 shows an alternative construction for the sound generating tube.

As an alternative construction, the internally corrugated tube can be made using a helical wire 31 covered by a sleeve of plastic material or metal, as generally shown in FIG. 3. The desired sound vibrations are produced by the gas flowing over the inner surfaces of the helix at the appropriate velocities, and are amplified in a horn portion 32.

Figure 2:
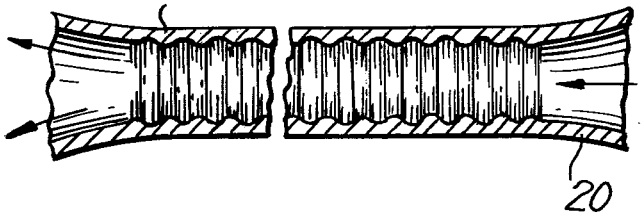
FIG. 2 shows a modified construction for the corrugated tube.
Figure 4:
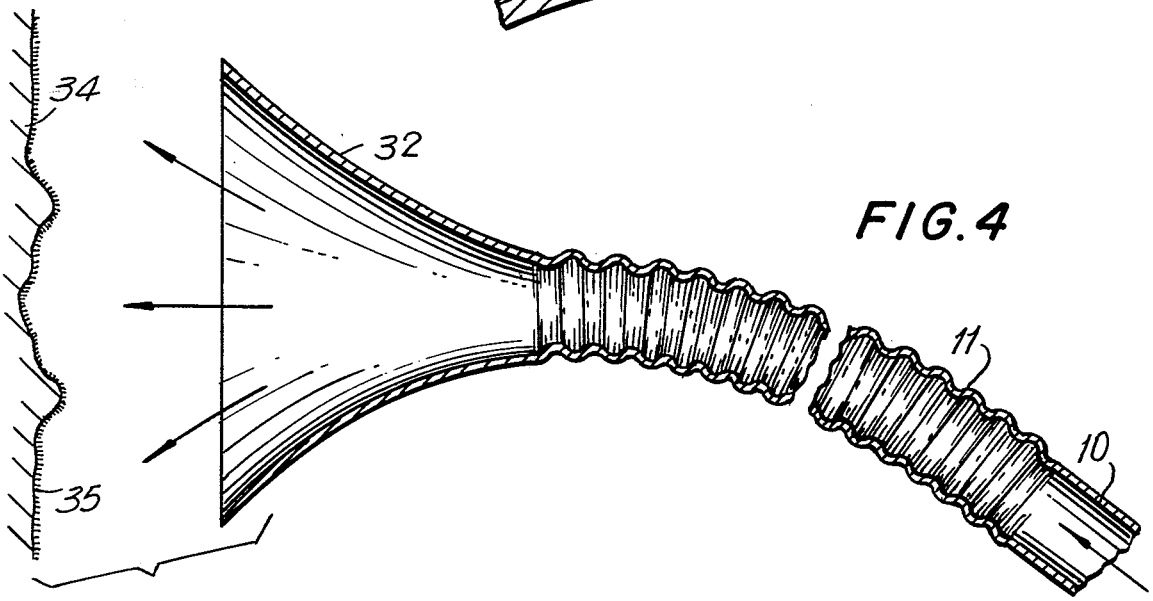
FIG. 4 shows an alternative embodiment of the invention used in combination with an adjacent surface being cleaned of deposited particles.

Although the corrugated tube 11 in which the sound vibrations are produced is usually made substantially straight as shown in FIGS. 1–3, the tube can, if desired, to fit into a more compact space be made curved as shown in FIG. 4. The radius of curvature should be at least about 1.0 ft. and usually 2–10 ft., as tubes having larger radii of curvature are usually more effective at producing sound vibrations of the desired frequency and intensity. Expanding horn 32 is directed toward an irregular shaped surface 34 containing accumulated particles layer 35. The spacing between the exit of horn 32 and surface 34 should be at least about ten ft., and usually should not exceed about 15 ft. for achieving effective cleaning.

Although the corrugated tube 11 and horn 12 can be made of a wide variety of materials including but not limited to metals, molded plastics, and plastics reinforced with filler materials such as carbon or glass depending on the service temperature and pressure requirements, the tube and horn will usually be made of metal suitable for relatively high temperature of 300–900 degrees F. The device is useful for any practical pressure level, and is preferably used at pressures of 0–500 psig. Fluids for which the invention is useful are any gas, such as air, steam or the actual process gas, for example, flue gas produced in a boiler from fuel combustion.

The invention will be further described by reference to the following typical example, which should not be construed as limiting in scope.

EXAMPLE

A sonic device having an internally corrugated tube attached at one end to an expanding horn is provided, and the horn is directed toward a heat transfer surface covered with deposited dust and soot particles. The corrugated tube has typical characteristics as follows:

| | |
|---|---|
| Tube inside diameter, in. | 1.18 (30 mm) |
| Pitch of corrugations, in. | 0.25 (6 mm) |
| Depth of corrugations, in. | 0.18 (4 mm) |
| Corrugated tube length, in. | 52 (1.33 M) |
| Number of corrugations | 180–190 |
| Tube length/diameter ratio | 40–50 |

Compressed flue gas is passed through the corrugated tube at a velocity in the range of 25–200 ft./sec. (8–60 M./sec.), and high intensity sound vibrations are generated in the tube. The outlet end of the expanding horn is directed toward a surface to be cleaned and spaced up to 10–15 ft. away from the surface. The dust and soot particles deposited on the heat exchanger surface are fluidized and dislodged from the surface by the high intensity sound vibrations emitted from the horn, and are removed by the flowing process gas and/or by gravity.

Although this invention has been described broadly and in terms of a preferred embodiment, it will be understood that modifications and variations can be made within the spirit and scope of the invention, which is described by the following claims.

I claim:

1. A sonic cleaning device using sound energy vibrations for removing fine particles accumulated on a surface, comprising:

(a) a tube having internally corrugated surfaces between inlet and outlet ends, said tube having a corrugation pitch of 0.2–0.5 inch and a length to inside diameter ratio at least about 10, for producing sound vibrations by a gas flowing through the tube; and (b) an expanding horn having its inlet end connected to the outlet end of said tube, whereby the horn is supported and directed towards a surface to be cleaned and a gas is passed through said tube and horn at a velocity sufficient to produce high intensity sound waves in the tube, so as to fluidize and remove particles from said surface, said tube and horn being composed of metal suitable for 300°–900° F., temperature service and up to about 500 PSIG. pressure.

2. The sonic cleaning device of claim 1, wherein said tube internal corrugations are substantially parallel.

3. The sonic cleaning device of claim 1, wherein said tube has a nominal inner diameter of 0.8–2.0 inches.

4. The sonic cleaning device of claim 1, wherein said tube length is 40–60 inches.

5. The sonic cleaning device of claim 1, wherein said tube has a length to inside diameter ratio of 20–60.

6. The sonic cleaning device of claim 1, wherein said horn outlet end is oriented toward a heat exchanger surface having accumulated particles thereon.

7. A sonic cleaning device using sound energy vibrations for removing fine particles accumulated on a surface, said device comprising:

(a) a metal tube having internally corrugated surfaces between inlet and outlet ends, and an inside diameter of 0.8–2.0 inches, said tube having a corrugation pitch of 0.2–0.5 inch and a length to inside diameter ratio of 10–100 for producing intense sound vibrations by a gas flowing through the tube; and (b) an expanding horn having its inlet end connected to the outlet end of said tube, whereby the horn is directed towards a surface to be cleaned and a gas is passed through said tube and horn at a velocity sufficient to produce high intensity sound waves in the tube, so as to fluidize and remove particles from said surface.

8. A method for removing accumulated fine particles from surfaces using sonic energy, comprising:

(a) passing a gas through an internally corrugated tube and an expanding horn connected in series flow relation, said gas having a superficial velocity in the tube of 25–200 ft./sec., and generating sound vibrations in the gas within said tube and amplifying said vibrations to produce an increased sound intensity from the horn;

(b) directing said horn toward a surface to be cleaned, and fluidizing the accumulated particles on the surface, and (c) removing the fluidized particles from said surface, by the flowing gas.

9. The method of claim 8, wherein the sound vibrations generated in the corrugated tube are amplified to at least about 100 decibels while passing said gas through said tube and horn.

10. The method of claim 8, wherein the accumulated particles are flushed by the flowing gas from the surface being cleaned.

11. The method of claim 8, wherein said amplified sound vibrations have an intensity of 120–160 decibels.

12. The method of claim 8, wherein the gas pressure in the corrugated tube is 0–500 psig.

13. The method of claim 8, wherein the flowing gas is process gas.

14. The method of claim 8, wherein the particles removed from the surface are carbon and soot.

15. The method of claim 8, wherein the surfaces being cleaned are heat exchange surfaces in a boiler.

16. The method of claim 8, wherein the flowing gas is air.

17. The method of claim 8, wherein the flowing gas is steam.

18. A method for removing accumulated fine particles from surfaces using sonic energy, said method comprising:

(a) passing a gas through an internally corrugated tube and an expanding horn connected in series flow relation to the tube, said gas having a superficial velocity in the tube of 25–200 ft./sec. and generating sound vibrations in said tube and sound intensity from said horn amplified to at least 100 decibels;

(b) directing said horn toward a surface to be cleaned and fluidizing the accumulated particles on the surface; and (c) flushing and removing the fluidized particles from said surface by the flowing gas.

* * * * *